US008286320B2

(12) United States Patent
Pienta et al.

(10) Patent No.: US 8,286,320 B2
(45) Date of Patent: Oct. 16, 2012

(54) APPARATUS AND METHOD FOR THE ROBOTIC PLUGGING/UNPLUGGING OF ROLLS

(75) Inventors: Daniel J. Pienta, Lambertville, MI (US); David M. Pienta, Lambertville, MI (US)

(73) Assignee: Automatic Handling International, Erie, MI (US)

( * ) Notice: Subject to any disclaimer, the term of this patent is extended or adjusted under 35 U.S.C. 154(b) by 502 days.

(21) Appl. No.: 12/586,045

(22) Filed: Sep. 16, 2009

(65) Prior Publication Data

US 2010/0065674 A1 Mar. 18, 2010

Related U.S. Application Data

(60) Provisional application No. 61/192,462, filed on Sep. 18, 2008.

(51) Int. Cl.

| | |
|---|---|
| ***B21D 39/00*** | (2006.01) |
| ***B23P 19/00*** | (2006.01) |
| ***B23Q 7/00*** | (2006.01) |
| ***B65H 19/00*** | (2006.01) |

(52) U.S. Cl. ..... 29/426.1; 29/429; 29/559; 29/700; 242/559; 414/222.01; 901/30; 901/40; 901/41

(58) Field of Classification Search ..... 29/430, 29/431, 559, 705, 783, 791, 822, 823, 824, 29/426.1, 700; 901/30, 31, 40, 41; 242/559; 414/222.01

See application file for complete search history.

(56) References Cited

U.S. PATENT DOCUMENTS

| | | | | |
|---|---|---|---|---|
| 3,951,271 | A * | 4/1976 | Mette | 414/591 |
| 4,267,985 | A * | 5/1981 | Rogers | 242/521 |
| 4,555,070 | A * | 11/1985 | Pali | 242/420.3 |
| 4,588,344 | A * | 5/1986 | Burke et al. | 242/559.3 |
| 4,610,404 | A * | 9/1986 | Maccaferri | 242/473.7 |
| 4,694,230 | A * | 9/1987 | Slocum et al. | 318/568.17 |
| 5,105,600 | A * | 4/1992 | DePoint et al. | 53/468 |
| 5,202,832 | A | 4/1993 | Lisy | |
| 5,265,999 | A * | 11/1993 | Wenschhof et al. | 414/226.02 |
| 5,333,803 | A | 8/1994 | Planeta | |
| 5,481,083 | A | 1/1996 | Smyth, Jr. | |
| 5,595,356 | A | 1/1997 | Kewin | |
| 5,674,049 | A * | 10/1997 | Pienta et al. | 414/798.7 |
| 5,984,623 | A * | 11/1999 | Smith et al. | 414/797 |
| 6,039,375 | A * | 3/2000 | Bauman | 294/119.1 |
| 6,058,587 | A * | 5/2000 | Smallwood | 29/426.1 |
| 6,273,360 | B1 | 8/2001 | Robinson | |
| 6,347,498 | B1 | 2/2002 | Pienta et al. | |
| 6,536,706 | B1 | 3/2003 | St. Germain et al. | |
| 6,592,324 | B2 * | 7/2003 | Downs et al. | 414/741 |

(Continued)

FOREIGN PATENT DOCUMENTS

EP 559581 A1 * 9/1993

(Continued)

*Primary Examiner* — Jermie Cozart

(74) *Attorney, Agent, or Firm* — Emch, Schaffer, Schaub & Porcello, Co., L.P.A.

(57) ABSTRACT

This machine generally is an apparatus for preparing rolls of previously wound material for an unwinding machine. More particularly industrial robots are used to improve the apparatus onto which rolls of sheet form material and the like can be loaded in preparation for unwinding and then, when a previously loaded roll has been unwound, disposing of the remaining core. The robots are programmable robots including a means for engaging the transfer plug and placing the plug into the tubular core of a large roll.

9 Claims, 3 Drawing Sheets

U.S. PATENT DOCUMENTS

| | | | | |
|---|---|---|---|---|
| 7,191,979 | B2 | 3/2007 | Paukov | |
| 2008/0240511 | A1* | 10/2008 | Ban et al. | 382/108 |
| 2008/0312769 | A1* | 12/2008 | Sato et al. | 700/249 |
| 2009/0025199 | A1* | 1/2009 | Hariki et al. | 29/430 |
| 2009/0067973 | A1* | 3/2009 | Eliuk et al. | 414/729 |
| 2009/0132086 | A1* | 5/2009 | Hariki et al. | 700/245 |

FOREIGN PATENT DOCUMENTS

| | | | |
|---|---|---|---|
| GB | 2192855 | A * | 1/1988 |
| JP | 02303779 | A * | 12/1990 |

* cited by examiner

APPARATUS AND METHOD FOR THE ROBOTIC PLUGGING/UNPLUGGING OF ROLLS

RELATED APPLICATIONS

This application is a conversion of U.S. Provisional Application No. 61/192,462, filed Sep. 18, 2008. The subject matter of the '462 application is hereby incorporated in its entirety by reference.

TECHNICAL FIELD

The present invention relates generally to an apparatus for preparing rolls of previously wound material to be placed on an unwinding machine for further processing into finished product. More particularly, industrial robots are used to improve the apparatus and process by which rolls of sheet material and the like can be loaded in preparation for unwinding and then, when a previously loaded roll has been unwound, disposing of the remaining core.

BACKGROUND OF THE INVENTION

Many products are manufactured from elongated sheet or stock material that is shipped and stored in the form of a roll or coil. Continuous strips or webs of thin, flexible material are commonly provided on storage rolls that are subsequently unwound for production of items made from these materials. Examples of these materials are plastic film, metal foil, tissue and paper.

During the manufacture of paper products such as napkins, newspapers, and magazines, for example, very large storage rolls of paper are used to provide the stock material from which the paper items are produced. The storage rolls are then unwound for further processing such as cutting, folding or printing.

Unwinding machines receive large rolls of sheet material wound on a tubular core and unwind the sheet material for processing. The rolls may have a length of up to about 300 inches (750 cm) and a weight of up to about 8,000 lbs (3600 kg). Processing on machines such as printing machines or laminating machines to which the sheet material is supplied by the unwinding machine usually require the sheet material to be supplied at a constant speed and tension. When nearly all the sheets on a roll have been unwound from the core, it is necessary for the machine to stop unwinding sheet from the almost empty roll and to commence unwinding sheet from a new roll without any interruption in the supply of sheets to the processing machine. It is thus necessary for the sheet to be cut from the nearly empty roll and to be secured to the sheet on the new roll to ensure a continuous supply of sheet.

BRIEF DESCRIPTION OF THE INVENTION

We have developed a unique way to use industrial robots to quickly change out the unwinding machine with a new roll once the previous roll is spent. The robots accept stand-by rolls of stock material ready to be plugged and prepared for quick movement into an unwinding position. This is highly desirable because of the savings in time that such a machine can provide. The stand-by roll can be quickly prepared for processing and then moved by a crane into position for unwinding. After unwinding the crane remove the spent roll from the unwind machine and the industrial robot remove the plugs.

The industrial robots are programmable robots operable to engage a selected transfer plug and position the transfer plug into the tubular core of a large roll of sheet material. The programmable, robot includes a microprocessor and software configured to sequentially plug and unplug full rolls and spent cores. The robot preferably includes an arm with an end effector. The core plug connects to the end effector. The end effector is configured to engage a multiplicity of plugs designed to fit a variety of sizes of tubular cores.

Other objects and advantages of the present invention will become apparent to those skilled in the art upon a review of the following detailed description of the preferred embodiments and the accompanying drawings.

DETAILED DESCRIPTION OF THE INVENTION

The invention is intended to be presented in a variety of alternative embodiments in an effort to adapt the primary crux of the invention to a variety of workplace and manufacturing layouts. As such, the figures provide alternative representations adapting the invention in a variety of applications.

Figure 1:
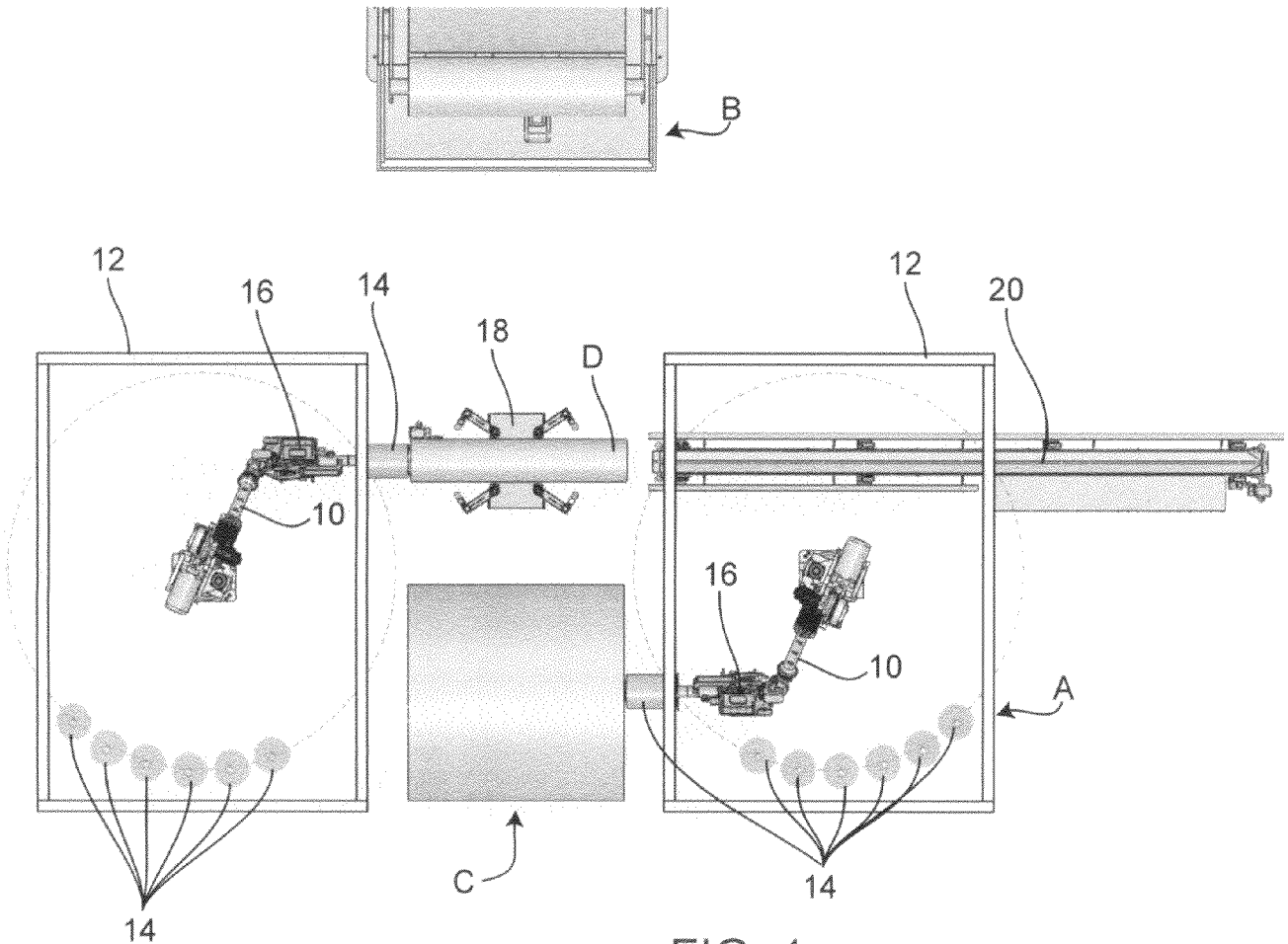
FIG. 1 is a top view of two programmable robots located in a core plugging and unplugging station adjacent an unwinding machine.

Referring now to FIG. 1, the invention is provided in core plugging station A which is positioned proximate an unwind machine B. A pair of industrial robots 10 are positioned inside safety cages 12. Plugs 14 of various diameters are located within the operating range of each industrial robot 10. The core plugs 14 are engaged by the end effector 16 of each robot 10. An incoming roll of sheet material C is positioned between the industrial robots 10. The industrial robot is programmable to select the proper diameter core plug 14 and insert the core plug 14 into the role of sheet material C. After the core plugs 14 are inserted into the roll of sheet material C, an overhead crane (not shown) engages the core plugs 14 and lifts the roll of sheet material C to the unwind machine B. Upon return, the overhead crane (not shown) will pick up a spent core D from which the sheet material has been unwound and return the spent core D to a spent core retaining clamp 18. The industrial robots 10 remove the core plugs 14 from the spent core D and the retaining clamp 18 places the spent core D on a core ejector conveyor 20. The spent core is then removed from the system.

Figure 2:
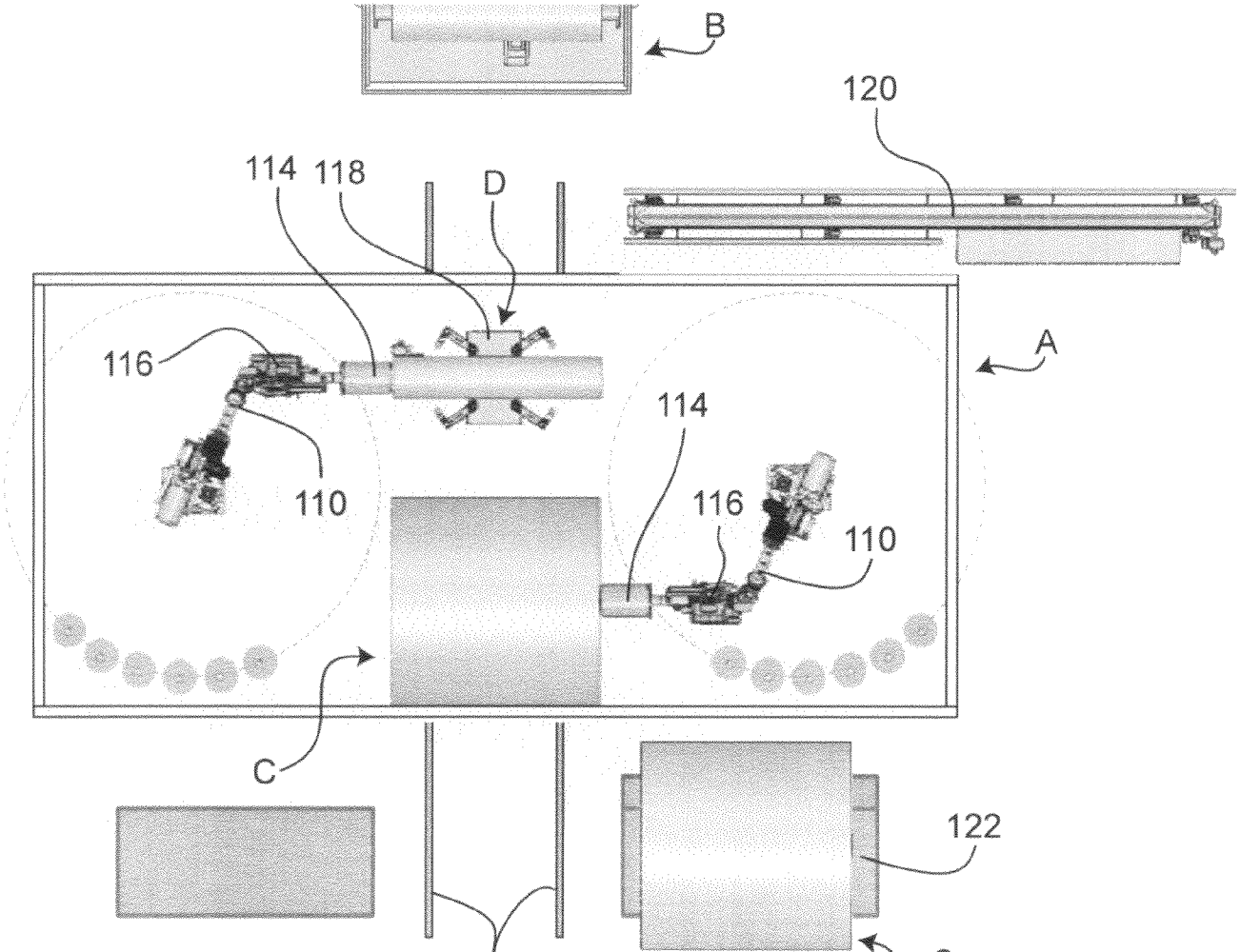
FIG. 2 is a top view or an alterative to FIG. 1 with the spent core conveyor located between the unwinding machine and the core plugging station.

Referring now to FIG. 2, an alternative embodiment of the invention is shown. In this embodiment, the roll of sheet material C is carried by carriage 122 which moves along tracks 124 to position the roll of sheet material inside the core station A proximate the industrial robots 110. The industrial robots 110 are located within safety cage 112. The industrial robots 110 are programmed to select the proper diameter core plug 114 with the end effector 116 and insert the core plug 114 into the roll of sheet material C. The roll of sheet material C is then engaged by an overhead crane (not shown) and transferred to the unwind machine B. Upon its return the overhead crane (not shown) retrieves a spent core D from which all sheet material has been removed and places the spent core D on the core retainer clamp 118. After the robots 110 remove the core plugs 114, the retaining clamp 118, moves the spent core to the ejector conveyor 120 which removes the spent core D from the core station A.

Figure 3:
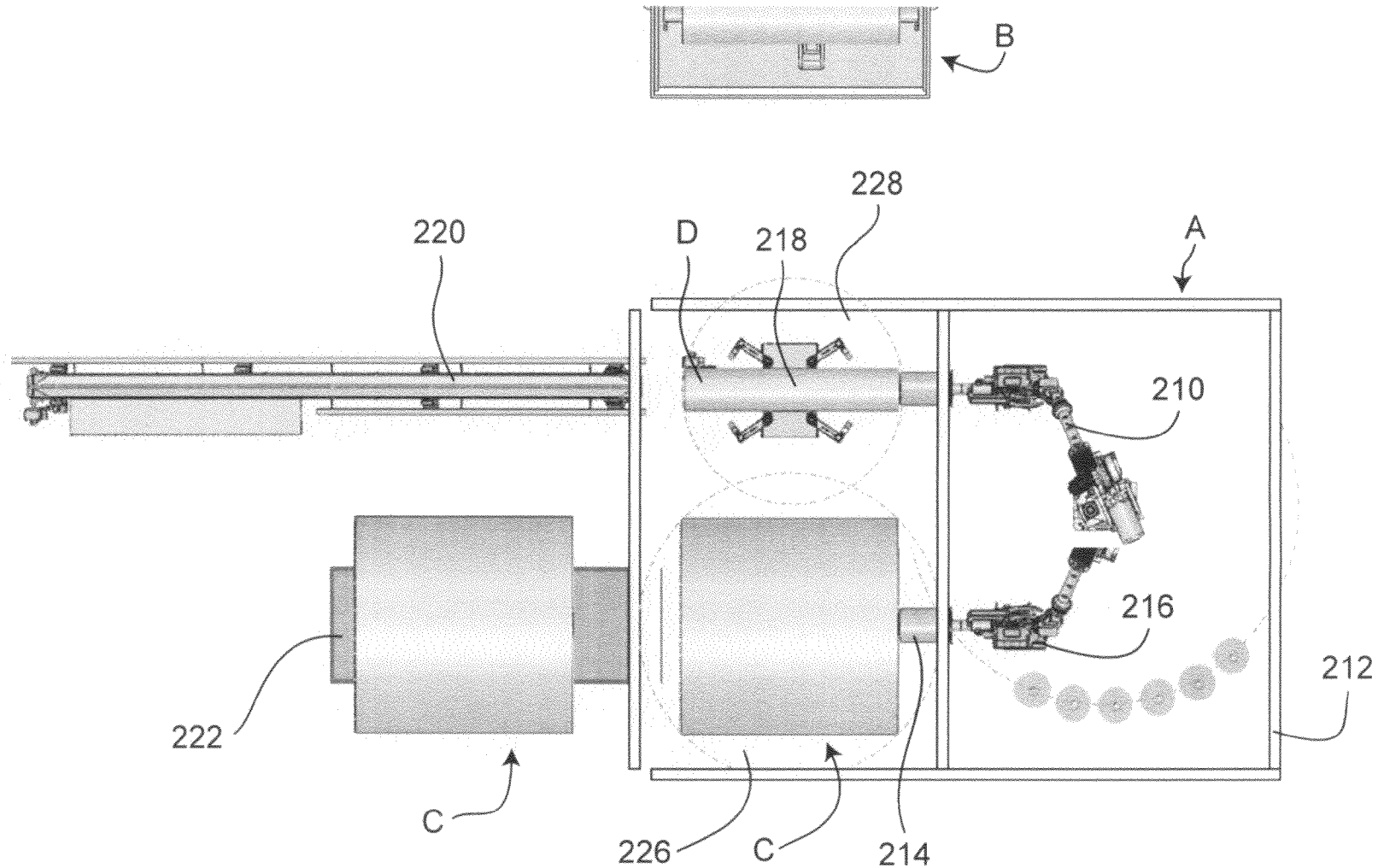
FIG. 3 is a top view of single programmable robot located in a core plugging and unplugging station adjacent an unwinding machine with rotatable turntables for both the incoming roll of sheet material and outgoing spent core.

Referring now to FIG. 3, a third embodiment of the invention is shown which utilizes a single robot 210. The single robot 210 is positioned in safety cage 212. The roll of sheet material C is transported by carriage 222 into a position proximate the robot 210. The robot 210 selects the proper diameter core plug 214 and carries the core plug 214 with its end effector 216 to plug one end of the roll of sheet material C. The roll of sheet material C once having received a plug 214 on one end is rotated via turntable 226 so that the robot 210 can insert a core plug 214 in the opposed end of the roll. Once the roll of sheet material C has received core plugs 214 on both ends, the roll of sheet material is engaged by an overhead crane (not shown) and taken to the unwind machine B. Upon returning to the core station A, the overhead crane retrieves a spent core D and places it in the spent core retaining clamp 218. The robot 210 removes a core plug 214 from one end of a spent core D. The spent core is then rotated by retaining clamp turntable 228 to position the remaining core plug 214 proximate the robot. The robot removes the remaining core plug 214 and the spent core D is removed from the core station A via ejector conveyor 220.

MODIFICATIONS

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. Apparatus for unwinding sheet material sequentially from a plurality of rolls of said sheet material, each roll being carried on a core having first and second open ends comprising:

(a) a supply containing a plurality of core plugs of different sizes;

(b) a programmable robot for selecting a core plug having a size suitable for insertion in each said open end;

(c) an effector operable by said robot for inserting said suitable sized plug in each said open end;

(d) means for delivering said roll of sheet material on said core with a plug in each said open end to an unwind machine;

(e) means for removing said core from said unwind machine following unwinding of said sheet material to a spent core; and (f) a clamp for engaging said spent core.

2. Apparatus according to claim 1 wherein said effector is operable to remove core plugs from spent cores.

3. Apparatus according to claim 1 wherein two programmable robots are provided, each having an effector for inserting a core plug in one of said open ends.

4. Apparatus according to claim 1 wherein a single programmable robot is provided and further including a rotator for rotating a roll of sheet material on a core from a first position at which said first open end is aligned with said effector for receiving a first core plug to a second position at which said second open end is aligned with said effector for receiving a second core plug.

5. Apparatus according to claim 4 further including a second rotator for rotating a spent core from a first position at which said first open end is aligned with said effector for removal of said first core plug therefrom to a second position at which said second open end is aligned with said effector for removal of said second core plug therefrom.

6. A method for unwinding sheet material sequentially from a plurality of rolls of said sheet material, each roll being carried on a core having first and second open ends comprising the steps of:

(a) providing a programmable robot and a plurality of core plugs of different sizes;

(b) causing said robot to select from said plurality a core plug for each of said open ends having a size suitable for insertion in each said open end;

(c) inserting said suitable sized core plug in each said open end;

(d) delivering said roll of sheet material on said core with a core plug in each said open end to an unwind machine;

(e) upon unwinding substantially all of said sheet material from said core to leave a spent core, removing said spent core from said unwinding machine;

(f) removing said core plugs from the open ends of said spent core;

(g) causing said robot to select a core plug of a suitable size for the core of the next sequential roll;

(h) inserting said suitable size core plug in each open end of the core of said next sequential roll; and (i) delivering said next sequential roll to said unwind machine.

7. The method according to claim 6 further including the step of providing two programmable robots, each having an effector, and actuating each said robot to cause one effector to insert a core plug in one of said open ends and the other effector to insert a core plug in the other of said open ends.

8. The method according to claim 6 wherein a single programmable robot is provided and further including the steps of providing a rotator and actuating said rotator following step (b) to rotate a roll of sheet material on a core from a first position at which said first open end is aligned with said effector for receiving a first core plug to a second position at which said second open end is aligned with said effector for receiving a second core plug.

9. The method according to claim 8 further including the steps of providing a second rotator and actuating said second rotator to rotate said spent core from a first position at which said first open end is aligned with said effector for removal of said first core plug therefrom to a second position at which said second open end is aligned with said effector for removal of said second core plug therefrom.

* * * * *